US007485078B1

(12) United States Patent
Chen

(10) Patent No.: US 7,485,078 B1
(45) Date of Patent: Feb. 3, 2009

(54) WAIST AND BUTTOCKS EXERCISER

(76) Inventor: Chih-Liang Chen, No. 66, Alley 71, Lane 252, Sec. 2, Jieshou Rd., Pateh City, Taoyuan Hsien (TW)

( * ) Notice: Subject to any disclaimer, the term of this patent is extended or adjusted under 35 U.S.C. 154(b) by 0 days.

(21) Appl. No.: 12/041,654

(22) Filed: Mar. 3, 2008

(51) Int. Cl.
*A63B 21/02* (2006.01)
*A63B 21/04* (2006.01)
*A63B 21/055* (2006.01)
*A63B 22/20* (2006.01)
*A63B 23/04* (2006.01)

(52) U.S. Cl. ..... 482/130; 482/121; 482/136; 482/147; 482/907

(58) Field of Classification Search ..... 482/71, 482/79, 80, 121–123, 126, 127, 129, 130, 482/136, 137, 142, 147, 907; D21/689; 297/423.37
See application file for complete search history.

(56) References Cited

U.S. PATENT DOCUMENTS 4,125,258 A * 11/1978 McArthur ..... 482/100
4,349,194 A * 9/1982 Lambert et al. ..... 482/100
5,255,957 A * 10/1993 Opsvik et al. ..... 297/423.12
5,393,286 A * 2/1995 Cheng ..... 482/130
5,409,439 A * 4/1995 Lee ..... 482/130
5,435,801 A * 7/1995 Hung ..... 482/130
5,518,482 A * 5/1996 Hsieh ..... 482/130
5,529,561 A * 6/1996 Wang et al. ..... 482/136
5,549,535 A * 8/1996 Wang et al. ..... 482/138
5,690,594 A * 11/1997 Mankovitz ..... 482/121
5,957,816 A * 9/1999 Staffa ..... 482/70
5,967,610 A * 10/1999 Lin ..... 297/340
6,117,055 A * 9/2000 Boland ..... 482/121
7,147,589 B2 * 12/2006 Chae ..... 482/51
7,223,220 B2 * 5/2007 Bendavid et al. ..... 482/130
7,361,127 B2 * 4/2008 Tremayne ..... 482/130
2006/0052224 A1 * 3/2006 Kellogg ..... 482/130
2006/0116259 A1 * 6/2006 Smith ..... 482/130

FOREIGN PATENT DOCUMENTS

DE 3408036 A1 * 8/1985

* cited by examiner

*Primary Examiner*—Loan H Thanh
*Assistant Examiner*—Victor K Hwang
(74) *Attorney, Agent, or Firm*—Pai Patent & Trademark Law Firm; Chao-Chang David Pai

(57) ABSTRACT

A waist and buttocks exerciser has a base, a seat being mounted pivotally on the base, multiple connectors being mounted on the base, a resilient rope being wrapped around the connectors and two leg supporters being attached rotatably onto the base. Each leg supporter has a pin being mounted through the leg supporter and being mounted between and abutting the resilient rope. When a user sits on the seat and places his feet on the leg supporters, the leg supporters can be driven toward different directions. With pins abutting and keeping pushing the resilient rope, user's waist, buttocks and thighs can be exercised.

19 Claims, 9 Drawing Sheets

WAIST AND BUTTOCKS EXERCISER

BACKGROUND OF THE INVENTION

1. Field of the Invention

The present invention relates to an exerciser, especially to a waist and buttocks exerciser that exercises waist, buttocks and thighs of a user at the same time.

2. Description of the Prior Arts

Nowadays, people usually have busy works and have no enough time to exercise outdoors. Therefore, various conventional exercise devices have been developed to allow people to exercise indoors and to maintain their health.

Since most people have to sit on chairs to work or read almost the whole days, their waist, buttocks and thighs are getting fatter. Therefore, exercising the waist, the buttocks and the thighs becomes the most important point of exercising.

However, the conventional exercise devices are huge, and exercising the waist, the buttocks and the thighs should be done in different conventional exercise devices. Thus, in order to be fit, people should buy many different conventional exercise devices that cost a lot and occupy much room.

To overcome the shortcomings, the present invention provides a waist and buttocks exerciser to mitigate or obviate the aforementioned problems.

SUMMARY OF THE INVENTION

The main objective of the present invention is to provide a waist and buttocks exerciser that has a base, a seat being mounted pivotally on the base, multiple connectors being mounted on the base, a resilient rope being wrapped around the connectors and two leg supporters being attached rotatably onto the base. Each leg supporter has a pin being mounted through the leg supporter and being mounted between and abutting the resilient rope.

When a user sits on the seat and places his feet on the leg supporters, the leg supporters can be driven toward different directions. With pins abutting and keeping pushing the resilient rope, user's waist, buttocks and thighs can be exercised.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
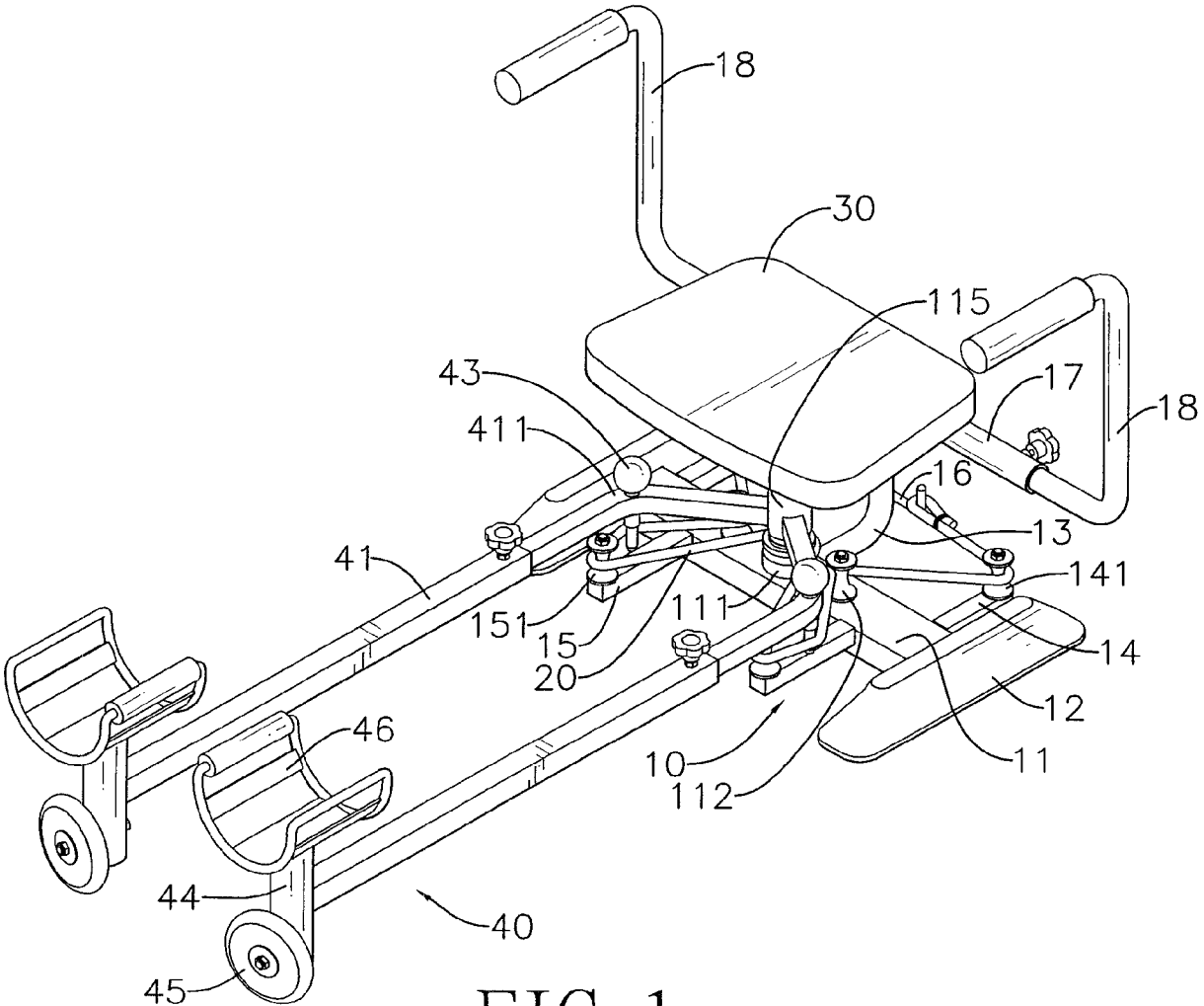
FIG. 1 is a perspective view of a waist and buttocks exerciser in accordance with the present invention.

With reference to FIG. 1, a waist and buttocks exerciser in accordance with the present invention comprises a base (10), a resilient rope (20), a seat (30) and two leg supporters (40).

Figure 2:
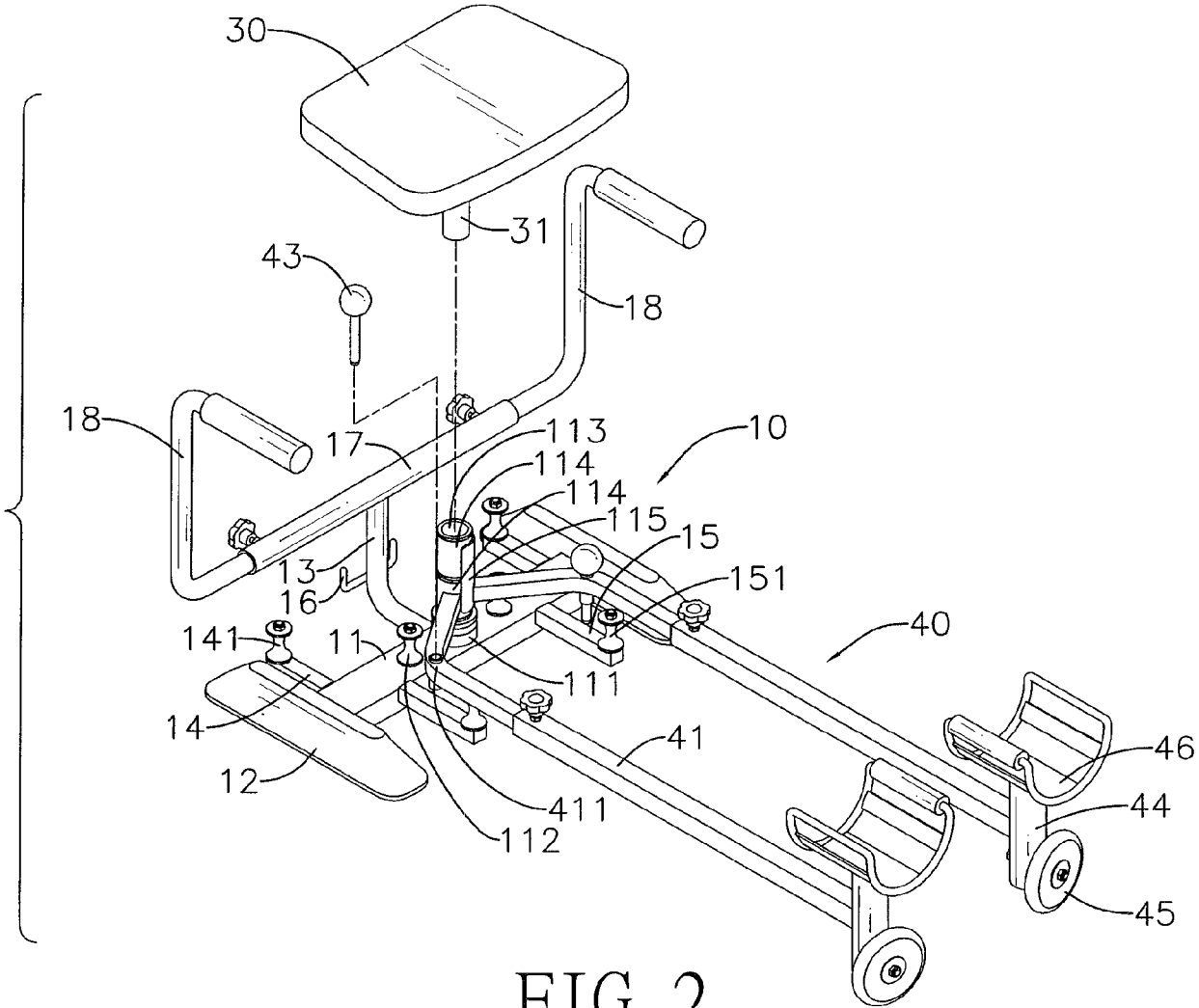
FIG. 2 is an exploded perspective view of the exerciser in FIG. 1.

With further reference to FIG. 2, the base (10) has an upper surface, a rear edge, a front edge, a connecting bar (11), a positioning ring (111), a pivot tube (113), two mounting tubes (114), an aligning connector (115), two first connectors (112), two feet (12), a supporting tube (13), a hook (16), two rear protrusions (14), two second connectors (141), two front protrusions (15) and two third connectors (151).

The connecting bar (11) has an upper surface, a rear edge, a front edge and two ends. The positioning ring (111) is mounted on the upper surface of the base (10), may be mounted on the upper surface of the connecting bar (11) and has a distal end. The pivot tube (113) is mounted on the upper surface of the base (10), may be mounted on the upper surface of the connecting bar (11), may be mounted on the distal end of the positioning ring (111) and has two opposite sides. The mounting tubes (114) are mounted rotatably around the pivot tube (113). The aligning connector (115) is arc, is attached securely to one of the mounting tubes (114). The first connectors (112) are mounted respectively on the upper surface of the base (10) near the opposite sides of the pivot tube (113) and may be mounted respectively on the upper surface of the connecting bar (11).

The feet (12) are attached respectively to the ends of the connecting bar (11) to hold the base (10) stably on a ground.

Figure 5:
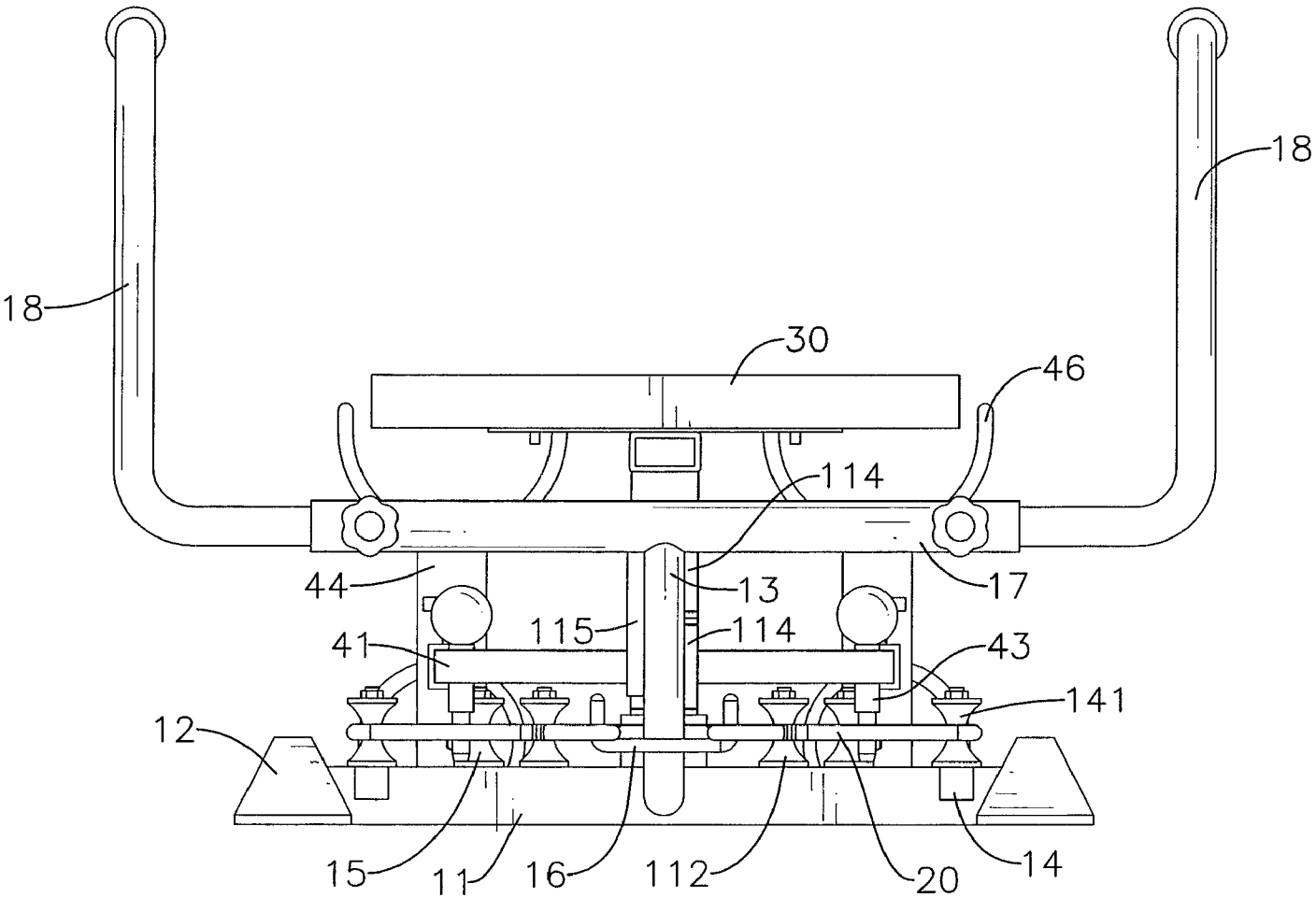
FIG. 5 is a rear view of the exerciser in FIG. 1.

With further reference to FIG. 5, the supporting tube (13) is mounted upwardly on the rear edge of the base (10), may be mounted on the rear edge of the connecting bar (11) and has a distal end, a connecting tube (17) and two holders (18). The connecting tube (17) is mounted perpendicularly on the distal end of the supporting tube (13) and has two ends. The holders (18) is mounted respectively and retractably in the ends of the connecting tube (17). The hook (16) is mounted on the supporting tube (13).

The rear protrusions (14) are mounted respectively on the rear edge of the connecting bar (11) near the feet (12). The second connectors (141) are mounted respectively on the upper surface of the base (10) near the rear edge of the base (10) and may be mounted respectively on the rear protrusions (14).

The front protrusions (15) are mounted respectively on the front edge of the connecting bar (11) respectively between the first connectors (112) and the rear protrusions (14). The third connectors (151) are mounted respectively on the upper surface of the base (10) near the front edge of the base (10) respectively between the first connectors (112) and the second connectors (141) and may be mounted respectively on the front protrusions (15).

Figure 6:
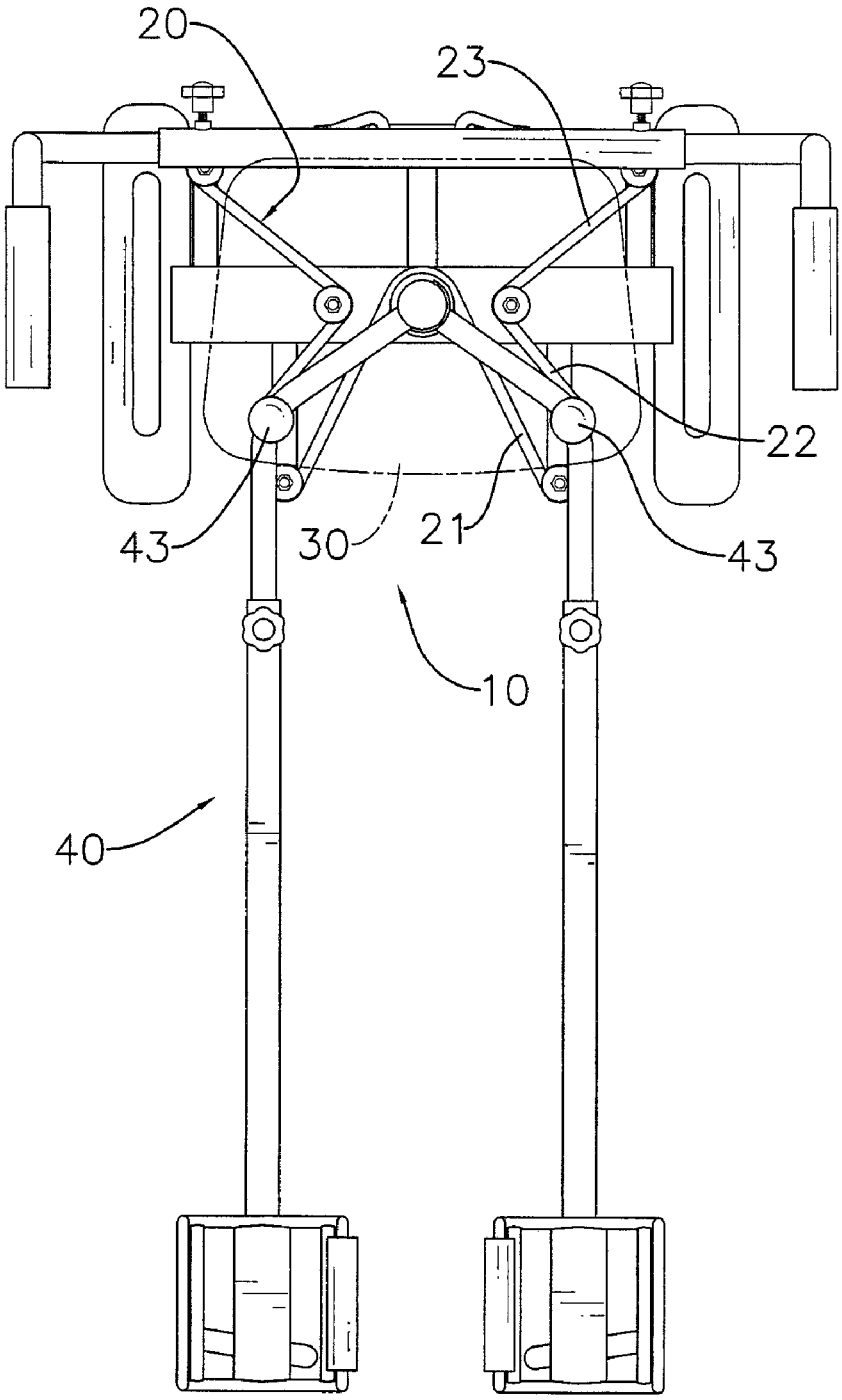
FIG. 6 is an upper view of the exerciser in FIG. 1.

With further reference to FIG. 6, the resilient rope (20) is wrapped around the first, second and third connectors (112, 141, 151) and has two ends, an inner side, an outer side, two first segments (21), two second segments (22) and two third segments (23). The ends of the resilient rope (20) is mounted securely on the base (10), may be mounted securely on the supporting tube (13) of the base (10) and may be mounted securely on the hook (16) of the supporting tube (13) of the base (10). The inner side of the resilient rope (20) abuts the second connectors (141) and the third connectors (151). The outer side of the resilient rope (20) abuts the first connectors (112) and the pivot tube (113) and may abut the positioning ring (111) of the base (10). The first segments (21) are mounted respectively between the pivot tube (113) and the third connectors (151). The second segments (22) are mounted respectively between the third connectors (151) and the first connectors (112). The third segments (23) are mounted respectively between the first connectors (112) and the second connectors (141).

Figure 3:
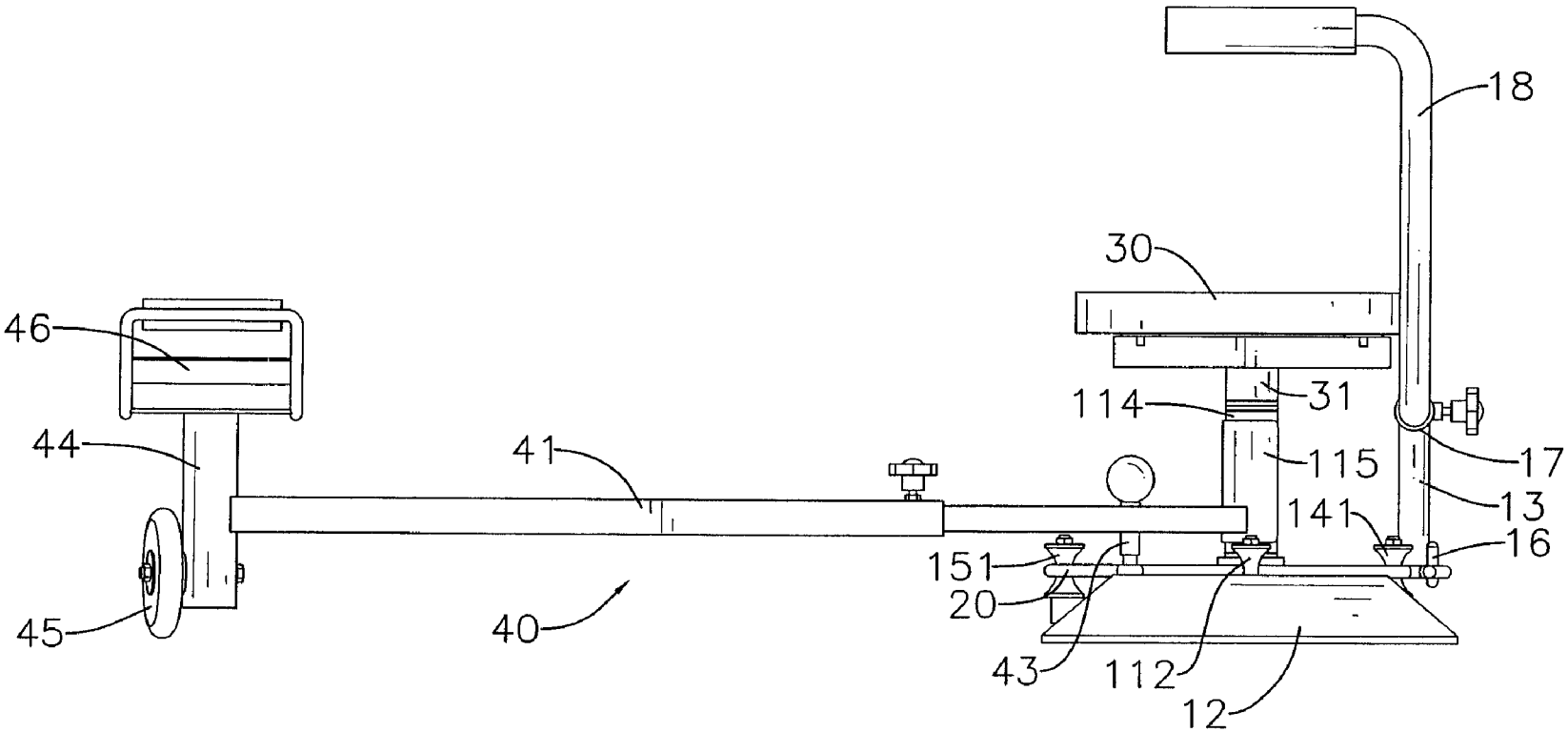
FIG. 3 is a side view of the exerciser in FIG. 1.
Figure 4:
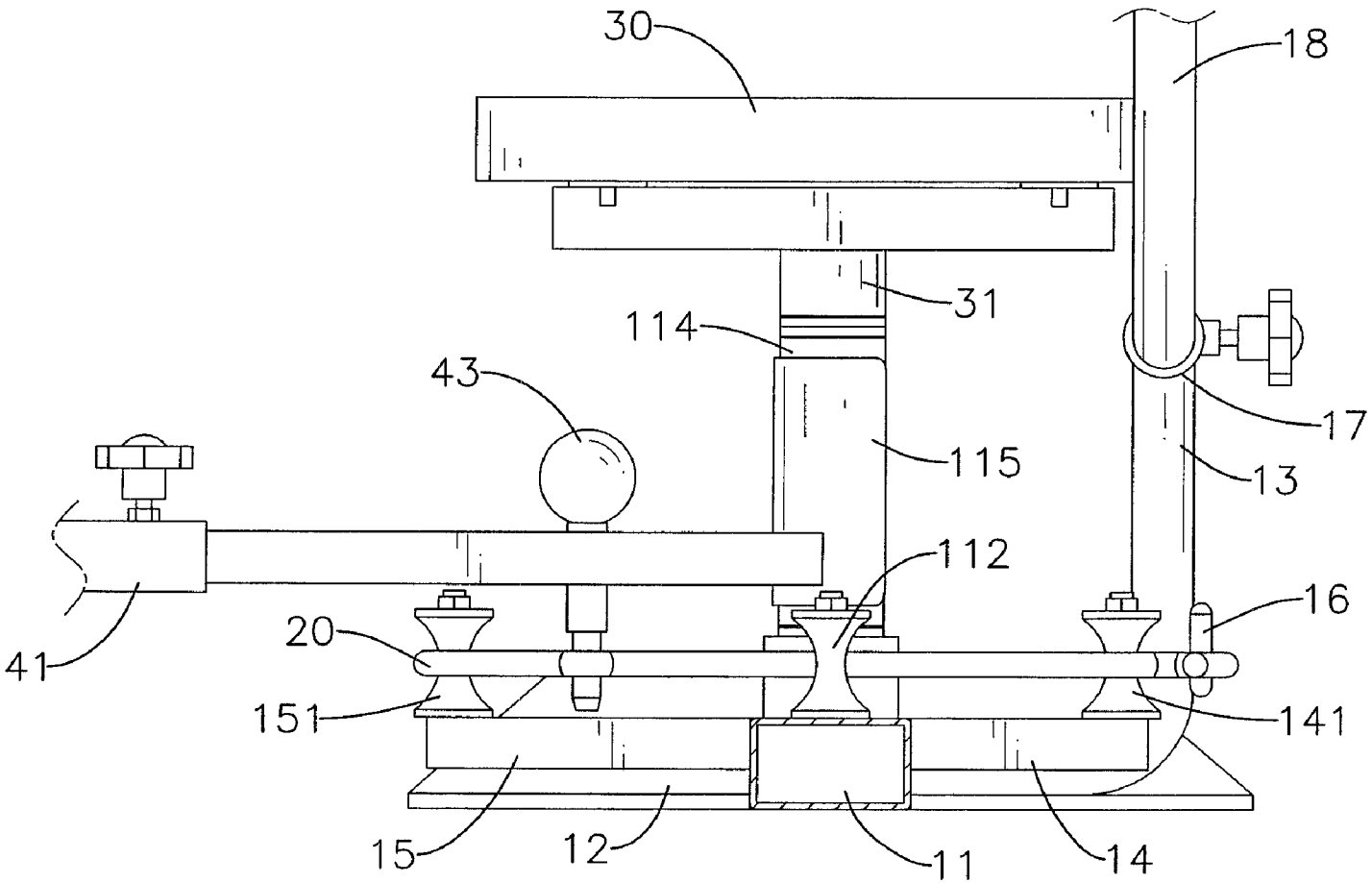
FIG. 4 is a partially enlarged side view of the exerciser in FIG. 1.

With further reference to FIGS. 3 and 4, the seat (30) is mounted pivotally in the pivot tube (113) of the base (10) and has a lower surface and a shaft (31). The shaft (31) is mounted on and protrudes from the lower surface of the seat (30) and is mounted pivotally in the pivot tube (113) of the base (10) to allow the seat (30) to pivot relative to the base (10).

The leg supporters (40) are attached respectively and securely onto the mounting tubes (114) of the base (10) to allow user's feet to place respectively on the leg supporters (40) and respectively move independently. Each leg supporter (40) has a leg (41), a pin (43), a connecting rod (44), a wheel (45) and a bracket (46).

The leg (41) is attached onto the corresponding mounting tube (114) of the base (10) and has a proximal end, a distal end and a curve rod (411). The leg (41) of one of the leg supporters (40) may be attached to the aligning connector (115) secured to one of the mounting tubes (114) while the leg (41) of the other leg supporter (40) is attached to the other mounting tube (114) to allow the leg supporters (40) move independently. The curve rod (411) is formed on the proximal end of the leg (41) and is attached to the corresponding mounting tube (114) of the base (10).

The pin (43) is mounted through the leg (41) of the leg supporter (40), may be mounted through the curve rod (411) of the leg (41) of the leg supporter (40) and is mounted selectively between the first segments (21) and the second segments (22) of the resilient rope (20) and is selectively adjacent to the third segments (23) of the resilient rope (20).

Figure 7:
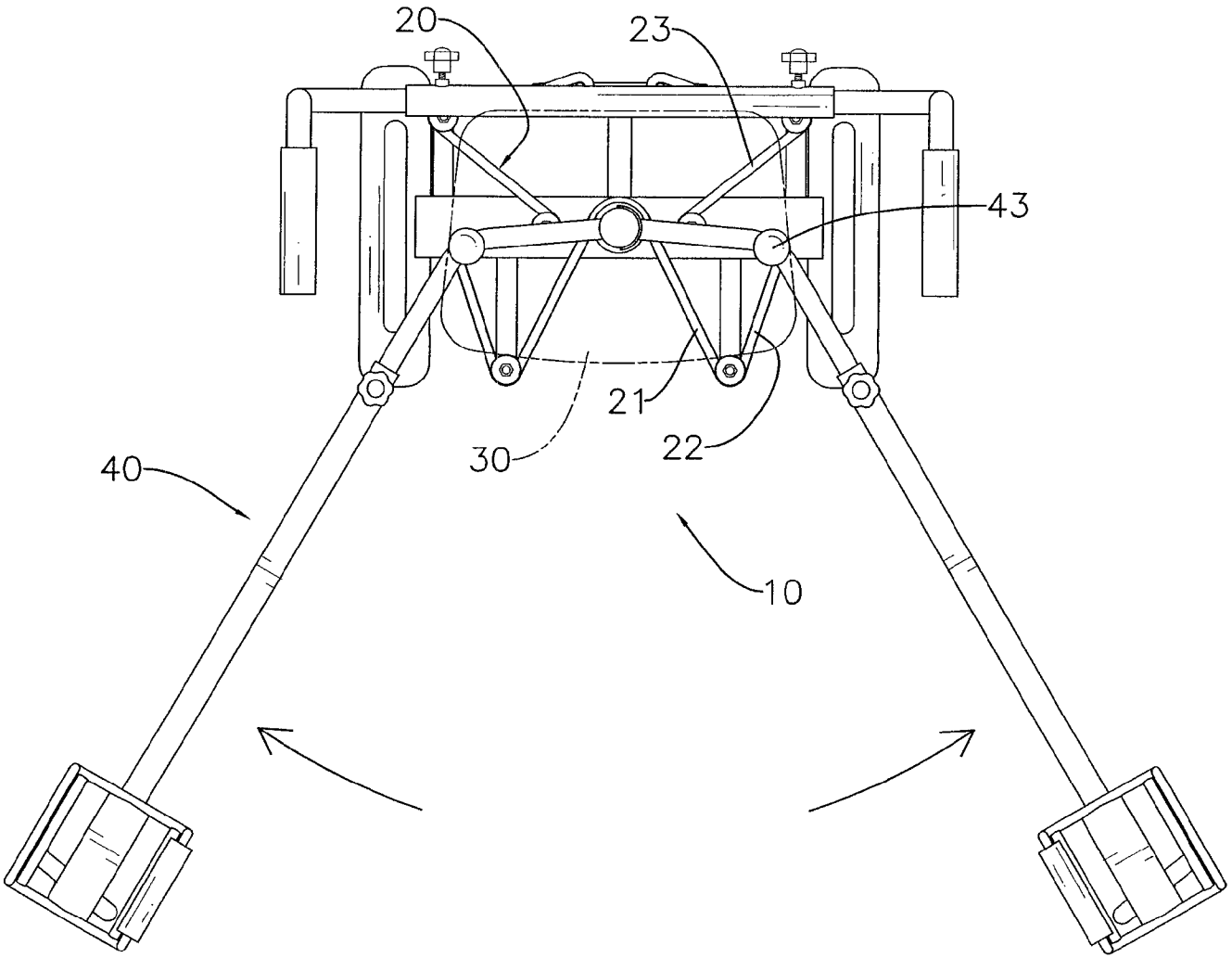
FIG. 7 is an operational upper view of the exerciser in FIG. 1, shown pins of leg supporters being mounted between a resilient rope and the leg supporters being driven toward reverse directions.

With further reference to FIGS. 6 and 7, when the pins (43) of the leg supporters (40) are mounted between the first segments (21) and the second segments (22) of the resilient rope (20), the user may move his feet to drive the leg supporters (40) toward reverse directions and the pins (43) may respectively abut and keep pushing the second segments (22) of the resilient rope (20). Therefore, user's thighs, especially inner and outer sides of the thighs, can be exercised.

Figure 8:
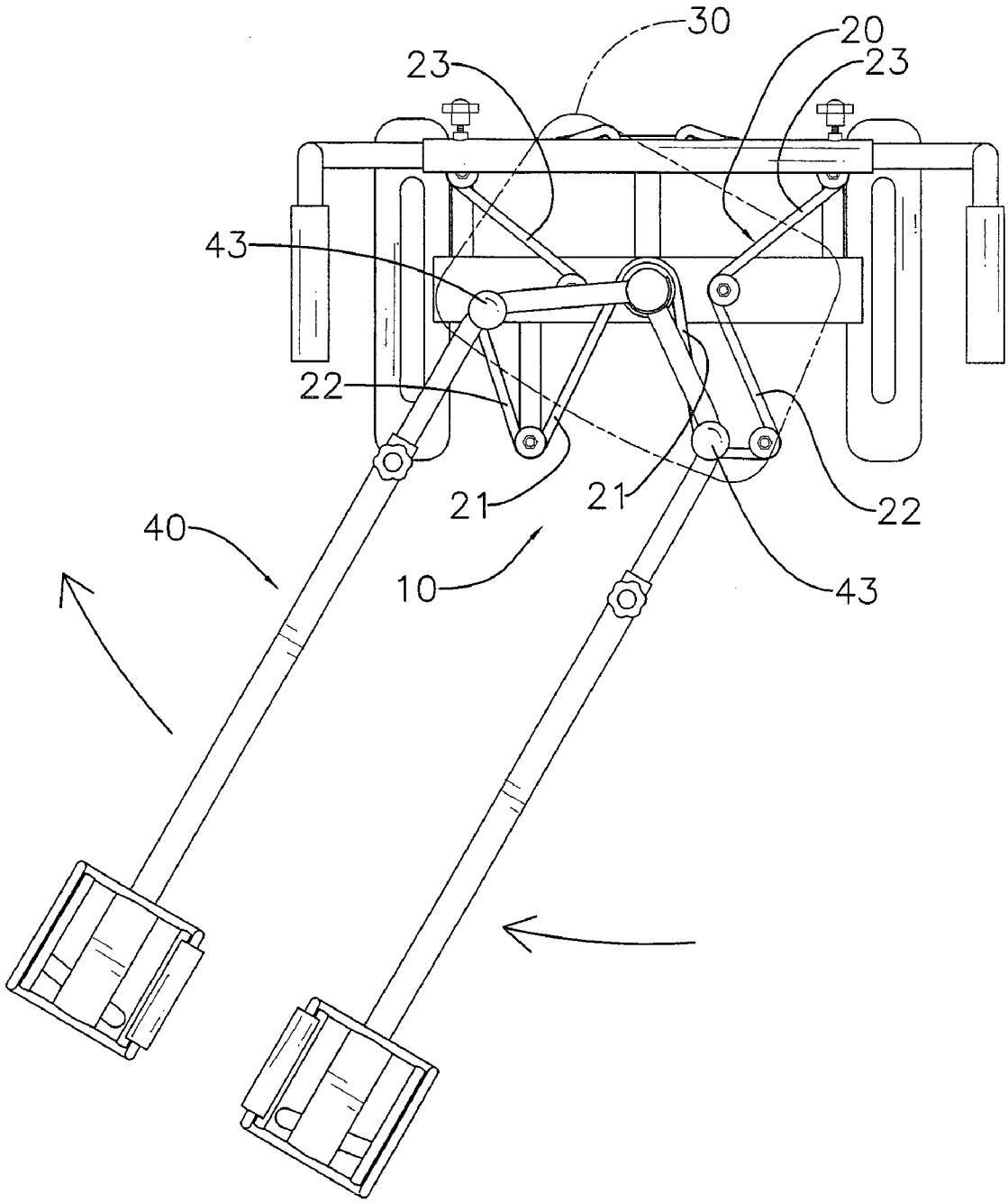
FIG. 8 is another operational upper view of the exerciser in FIG. 1, shown the pins of the leg supporters being mounted between the resilient rope and the leg supporters being driven toward a same direction.

Furthermore, with further reference to FIG. 8, the user may move his feet to drive the leg supporters (40) toward a same direction and one of the pins (43) may abut and keep pushing one of the second segments (22) of the resilient rope (20) while the other pin (43) may abut and keep pushing one of the first segments (21) of the resilient rope (20). Therefore, user's waist, buttocks and the thighs can be exercised at the same time.

Figure 9:
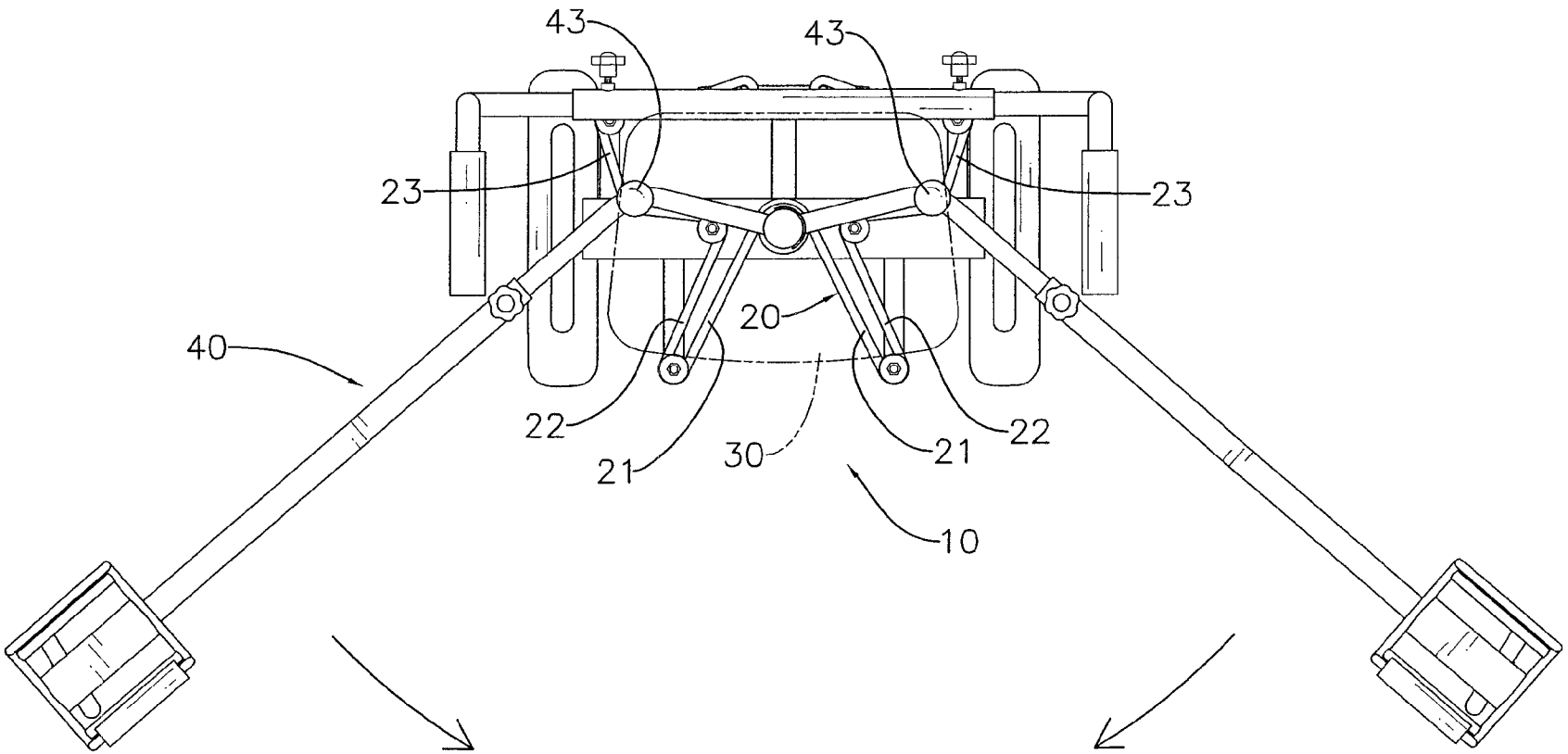
FIG. 9 is still another operational upper view of the exerciser in FIG. 1, shown the pins of the leg supporters being adjacent to the resilient rope and the leg supporters being driven toward each other.

With further reference to FIG. 9, when the pins (43) of the leg supporters (40) are adjacent to the third segments (23) of the resilient rope (20), the user may move his feet to drive the leg supporters (40) toward each other and the pins (43) may respectively abut and keep pushing the third segments (23) of the resilient rope (20). Therefore, user's thighs, especially inner sides of the thighs, can be exercised.

The connecting rod (44) is attached to the distal end of the leg (41) and has a lower end and an upper end.

The wheel (45) is mounted on the distal end of the leg (41) of the leg supporter (40) and may be mounted on the lower end of the connecting rod (44) to allow the leg supporter (40) to move smoothly on the ground.

The bracket (46) is mounted on the leg (41) of the leg supporter (40) and may be mounted on the upper end of the connecting rod (44) to allow user's leg to place stably in the bracket (46).

The waist and buttocks exerciser as described is mobile and especially practicable for exercising and has the following advantages. When the user sits on the seat (30) and places his feet on the leg supporters (40), the leg supporters (40) can be driven toward different directions. With pins (43) abutting and keeping pushing different segments (21, 22, 23) of the resilient rope (20), user's waist, buttocks and thighs can be exercised.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An exerciser comprising a base having an upper surface;

a rear edge;

a front edge;

a pivot tube being mounted on the upper surface of the base and having two opposite sides;

two mounting tubes being mounted rotatably around the pivot tube;

two first connectors being mounted respectively on the upper surface of the base near the opposite sides of the pivot tube;

two second connectors being mounted respectively on the upper surface of the base near the rear edge of the base; and two third connectors being mounted respectively on the upper surface of the base near the rear edge of the base, and each third connector being mounted between a corresponding first connector and a corresponding second connector;

a resilient rope being wrapped around the first, second and third connectors and having two ends being mounted securely on the base;

a seat being mounted pivotally in the pivot tube of the base and having a lower surface; and a shaft being mounted on and protruding from the lower surface of the seat and being mounted pivotally in the pivot tube of the base; and two leg supporters being attached respectively and securely onto the mounting tubes of the base and each leg supporter having a leg being attached onto a corresponding mounting tube of the base and having a proximal end; and a distal end; and a pin being mounted through the leg of the leg supporter.

2. The exerciser as claimed in claim 1, wherein the resilient rope further has an inner side abutting the second connectors and the third connectors; and an outer side abutting the first connectors and the pivot tube.

3. The exerciser as claimed in claim 2, wherein the base further has a connecting bar having
an upper surface;
a rear edge;
a front edge; and
two ends;
two feet being attached respectively to the ends of the connecting bar;
two rear protrusions being mounted respectively on the rear edge of the connecting bar near the feet; and
two front protrusions are mounted respectively on the front edge of the connecting bar, and each front protrusion being mounted between a corresponding first connector and a corresponding rear protrusion;
the pivot tube is mounted on the upper surface of the connecting bar;
the first connectors is mounted respectively on the upper surface of the connecting bar;
the second connectors is mounted respectively on the rear protrusions; and
the third connectors is mounted respectively on the front protrusions.

4. The exerciser as claimed in claim 3, wherein
the base further has
a positioning ring being mounted on the upper surface of the connecting bar and having a distal end; and
an aligning connector being arc, being attached securely to one of the mounting tubes;
the pivot tube is mounted on the distal end of the positioning ring;
the resilient rope abuts the positioning ring of the base; and
the leg of one of the leg supporters is attached to the aligning connector secured to one of the mounting tubes while the leg of the other leg supporter is attached to the other mounting tube.

5. The exerciser as claimed in claim 4, wherein
the leg of each leg supporter further has a curve rod being formed on the proximal end of the leg and being attached to the corresponding mounting tube of the base; and
the pin of each leg supporter is mounted through the curve rod of the leg of the leg supporter.

6. The exerciser as claimed in claim 3, wherein each leg supporter further has a wheel being mounted on the distal end of the leg of the leg supporter.

7. The exerciser as claimed in claim 6, wherein each leg supporter further has a bracket being mounted on the leg of the leg supporter.

8. The exerciser as claimed in claim 7, wherein
each leg supporter further has a connecting rod being attached to the distal end of the leg and having
a lower end; and
an upper end;
the wheel of each leg supporter is mounted on the lower end of the connecting rod; and
the bracket of each leg supporter is mounted on the upper end of the connecting rod.

9. The exerciser as claimed in claim 6, wherein
the base further has a supporting tube being mounted upwardly on the rear edge of the base and having
a distal end;
a connecting tube being mounted perpendicularly on the distal end of the supporting tube and having two ends; and
two holders being mounted respectively and retractably in the ends of the connecting tube; and
the ends of the resilient rope is mounted securely on the supporting tube of the base.

10. The exerciser as claimed in claim 9, wherein
the base further has a hook being mounted on the supporting tube; and
the ends of the resilient rope is mounted securely on the hook of the supporting tube of the base.

11. The exerciser as claimed in claim 2, wherein the resilient rope further has
two first segments being mounted respectively between the pivot tube and the third connectors;
two second segments being mounted respectively between the third connectors and the first connectors; and
two third segments being mounted respectively between the first connectors and the second connectors.

12. The exerciser as claimed in claim 1, wherein
the base further has
a connecting bar having
an upper surface;
a rear edge;
a front edge; and
two ends;
two feet being attached respectively to the ends of the connecting bar;
two rear protrusions being mounted respectively on the rear edge of the connecting bar near the feet; and
two front protrusions are mounted respectively on the front edge of the connecting bar, and each front protrusion being mounted between a corresponding first connector and a corresponding rear protrusion;
the pivot tube is mounted on the upper surface of the connecting bar;
the first connectors is mounted respectively on the upper surface of the connecting bar;
the second connectors is mounted respectively on the rear protrusions; and
the third connectors is mounted respectively on the front protrusions.

13. The exerciser as claimed in claim 12, wherein
the base further has
a positioning ring being mounted on the upper surface of the base and having a distal end; and
an aligning connector being arc, being attached securely to one of the mounting tubes;
the pivot tube is mounted on the distal end of the positioning ring;
the resilient rope abuts the positioning ring of the base; and
the leg of one of the leg supporters is attached to the aligning connector secured to one of the mounting tubes while the leg of the other leg supporter is attached to the other mounting tube.

14. The exerciser as claimed in claim 13, wherein
the leg of each leg supporter further has a curve rod being formed on the proximal end of the leg and being attached to the corresponding mounting tube of the base; and
the pin of each leg supporter is mounted through the curve rod of the leg of the leg supporter.

15. The exerciser as claimed in claim 12, wherein each leg supporter further has a wheel being mounted on the distal end of the leg of the leg supporter.

16. The exerciser as claimed in claim 15, wherein each leg supporter further has a bracket being mounted on the leg of the leg supporter.

17. The exerciser as claimed in claim 16, wherein
each leg supporter further has a connecting rod being attached to the distal end of the leg and having
a lower end; and
an upper end;

the wheel of each leg supporter is mounted on the lower end of the connecting rod; and the bracket of each leg supporter is mounted on the upper end of the connecting rod.

18. The exerciser as claimed in claim 15, wherein the base further has a supporting tube being mounted upwardly on the rear edge of the base and having a distal end;

a connecting tube being mounted perpendicularly on the distal end of the supporting tube and having two ends; and two holders being mounted respectively and retractably in the ends of the connecting tube; and the ends of the resilient rope is mounted securely on the supporting tube of the base.

19. The exerciser as claimed in claim 18, wherein the base further has a hook being mounted on the supporting tube; and the ends of the resilient rope is mounted securely on the hook of the supporting tube of the base.

* * * * *